United States Patent [19]

Dolveck

[11] 4,241,844

[45] Dec. 30, 1980

[54] AEROSOL DISPENSING AND SIMILAR METAL CANS, AND PROCESS FOR THE PRODUCTION THEREOF

[75] Inventor: Gilbert Dolveck, St. Barthélémy de Beaurepaire, France

[73] Assignee: Aluminium Suisse S.A., Switzerland

[21] Appl. No.: 699,793

[22] Filed: Jun. 25, 1976

Related U.S. Application Data

[62] Division of Ser. No. 448,054, Mar. 4, 1974, Pat. No. 3,965,834.

[30] Foreign Application Priority Data

Mar. 8, 1973 [CH] Switzerland ..... 3380/73

[51] Int. Cl.[3] ..... B65D 8/04; B65D 8/08

[52] U.S. Cl. ..... 220/67; 220/3

[58] Field of Search ..... 220/67, 66, 3

[56] References Cited

U.S. PATENT DOCUMENTS

| | | | |
|---|---|---|---|
| 1,412,966 | 4/1922 | Richman | 220/67 |
| 1,607,923 | 11/1926 | Sebell | 220/67 |
| 2,795,350 | 6/1957 | Lapin | 220/67 |
| 2,849,148 | 8/1958 | Lohuis | 220/67 |
| 3,452,897 | 7/1969 | Anthony | 220/67 |
| 3,543,996 | 12/1970 | West | 220/67 X |
| 3,586,204 | 6/1971 | Roper | 220/67 |
| 3,965,834 | 6/1976 | Dolveck | 220/67 X |

*Primary Examiner*—Steven M. Pollard

*Attorney, Agent, or Firm*—Robert E. Burns; Emmanuel J. Lobato; Bruce L. Adams

[57] ABSTRACT

An aerosol dispensing metal can has a tubular side wall and a separate bottom fitted to the side wall by a channel-forming inwardly-folded edge portion of the side wall in which channel a peripheral skirt of the bottom is hookably engaged. The joint can be sealed by a polymeric varnish.

8 Claims, 18 Drawing Figures

Figure 1:
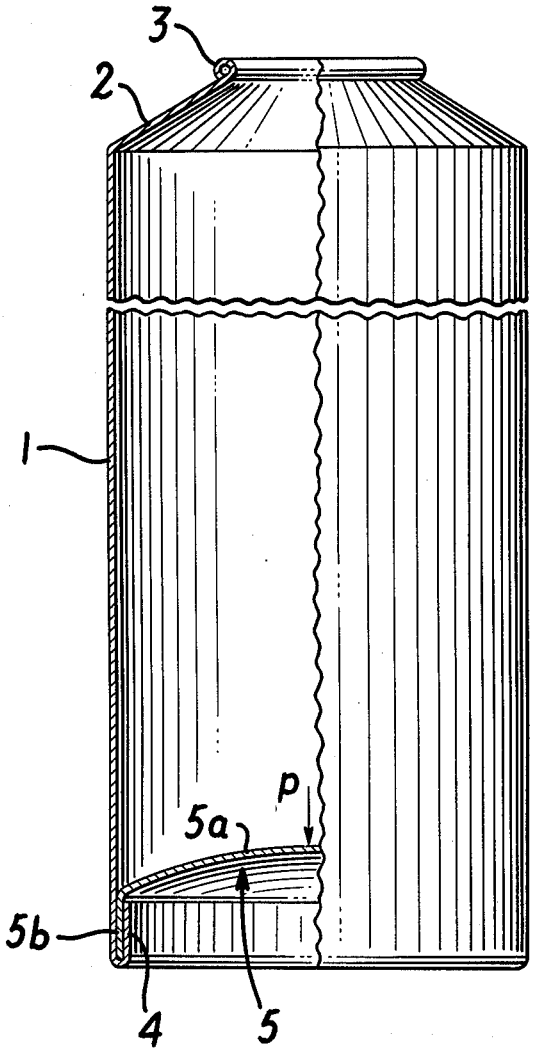

AEROSOL DISPENSING AND SIMILAR METAL CANS, AND PROCESS FOR THE PRODUCTION THEREOF

This is a divisional, of application Ser. No. 448,054, filed Mar. 4, 1974, now U.S. Pat. No. 3,965,834.

The invention relates to aerosol dispensing and similar metal cans adapted to contain a pressurized fluid in the form of a liquid, pulverulent or pasty product and/or a gas under pressure, of the type comprising a tubular body and a bottom fitted to the tubular body.

Aluminium aerosol dispensing cans in which the bottom is made in a single piece with the cylindrical wall of the can are known. The possibilities of shaping the upper part of such cans, intended to receive the valve and cup, are however very limited and it is notably difficult at the present to form a trunco-conical part making a distinct angle with a cylindrical lower part of the wall. Also, it is difficult to provide one-piece cans with a material other than aluminium since narrowing of a neck portion involves further difficulties. For these reasons, cans with fitted bottoms are still in great demand. However, the lower parts of known cans with fitted bottoms do not have the smooth and uniform aspect of one-piece cans, but the joint or seam forms a visible collar protruding from the periphery of the can. Such protruding seams have several disadvantages. Firstly, upon filling the cans, during which operation the cans are empty and hence light and unstable, they cannot bear against one another on a conveyor belt since the main part of their bodies are held slightly spaced apart from one another by their protruding seams. For the same reason, during transport, the cans tend to knock against one another which involves various risks, for example of damage to an outer coating or printed matter on the cans. Furthermore, since it is not possible to apply the cans against one another along their generatrices, packaging several cans within a thermo-retractable envelope is practically impossible. Another drawback is that the seams form seats in which dirt can accumulate at a location liable to be contacted by the user's hand which is undesirable for example for disinfectant aerosol sprays for use by dentists or doctors. Finally, these protruding seams constitute waste space for stocking and displaying the cans by a retailer.

With a view to obviating these drawbacks, the applicant firstly proposed a reduction of the outer diameter of the seam to the outer diameter of the cylindrical part of the can body, but the seam nevertheless remained visible and still formed an objectionable seat for dirt. Secondly, the applicant has proposed pushing the seam inside the body of the can by a special process. The visible wall of the can thus obtained no longer has a discontinuity, which is an important advantage in this field where improvement of the aesthetic appearance is as important as improvements of purely mechanical characteristics.

The present invention aims not only to conceal the joint between the bottom and the side wall of the can, but to replace the conventional rolled seam type joint by a new type of joint relying mainly on a simple hooking action, and thus to simplify the manufacture.

According to the invention, there is provided an aerosol dispensing or similar metal can adapted to contain a pressurized fluid, comprising a tubular side wall and a separate bottom fitted to the side wall, wherein the side wall has an edge portion which is folded over inwardly to form with an adjacent portion of the side wall a channel, and the bottom has a peripheral skirt hookably engaged in said channel.

The invention also concerns a process for assembling such a can, comprising inserting the bottom with its peripheral skirt into an open end of the tubular side wall whereby the edge of the skirt is spaced in from the edge of the side wall, and inwardly folding over an edge portion of the side wall to form a channel in which the skirt is engaged.

The tubular side wall may be cylindrical, but not necessarily, and the same applies to the skirt which may be cylindrical, conical, pyramid-shaped or prismatic.

Preferably, the outer transverse dimensions of the skirt of the bottom, for example its diameter in the case of a bottom with a cylindrical skirt, are slightly greater than the corresponding inner dimensions of the side wall so that the bottom is force fitted in the side wall and maintains itself in the desired zone of the latter during the operation of forming the gutter.

When the can is placed under pressure, the bottom is applied by the pressure in the can in the channel of the side wall and, contrary to what could be expected, a sealing can be ensured by this contact under pressure.

It is however possible to improve sealing of the joint by using a synthetic resin or another suitable product, for example rubber. A particularly advantageous sealing process consists of employing the type of polymeric varnish with which the insides of aerosol cans are usually coated. To this end, the can and bottom are varnished and the bottom is put in place before polymerizing the varnish, this even preferably being carried out at the end of the operations, i.e. after forming the channel.

To sum up, the invention enables the bottom to be concealed inside the can body and to eliminate the seam-beading operation which is replaced by a folding operation.

Figure 1A:
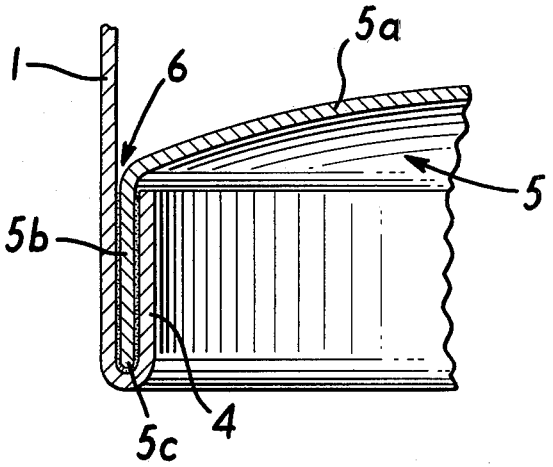

The accompanying drawings show, by way of example, several embodiments of the invention. In the drawings:

FIG. 1 is an elevational view, half in axial cross-section, of a generally cylindrical aerosol can;

FIG. 1*a* is an enlarged scale view of a detail of FIG. 1; and

FIGS. 2 to 16 are schematic views of different embodiments in which means are provided for preventing a premature ripping off of the bottom after turning over thereof in the case of an overpressure.

The can shown in FIG. 1 has a generally cylindrical body formed by a cylindrical side wall 1, for example in alumimum, whose upper part 2 is trunco-conical and terminates with a rolled edge 3 adapted to receive a distributing valve, or more precisely a cup carrying this valve. The lower edge of wall 1 is folded back on itself to form a closed annular gutter or channel 4. The bottom 5 has a dished central part 5*a* the concave face of which is directed outwards, and a cylindrical peripheral skirt 5*b* engaged in channel 4. The height of skirt 5*b* is greater than the height of the edge of the channel 4 so that the lower edge 5*c* of this skirt abuts against the bottom of the channel 4 so that a hooking of the bottom by its skirt is ensured. The pressure P in the filled can, which is of the order of 2.5 to 6.6 kg/cm$^2$ at a temperature of 20° C., acts at the lower edge 5*c* of skirt 5*b* with a pressure several times greater, this increase in pressure being proportional to the ratio of the area of the part 5*a* to the area of edge 5*c* which bears against the bottom of the channel 4. This pressure alone may, in certain cases, be sufficient to ensure a sealing of the can.

Placing and securing of the bottom takes place in the following manner:

Firstly, the bottom 5 provided with its skirt **5*b* is introduced into the open end of side wall 1 in such a manner that the edge 5*c* of the skirt is slightly spaced from the non-folded over edge of the side wall. Then the lower part of the side wall is folded inwardly and bent over to form the channel 4**.

The bottom 4 is preferably initially introduced by an amount so that the edge **5*c* is inserted by a lesser amount than in its final position, i.e. the height of the part of the side wall extending beyond the edge 5*c* is less than the height of the finished channel 4. Upon forming of the channel, the bottom 5 is thus progressively axially pushed by its skirt 5*b* inside the tubular body, with the edge 5*c* of its skirt firmly abutting against the bottom of the channel 4**. The fold can then be flattened by a milling or rolling operation, or left unflattened.

Aerosol cans generally have an inner coating of a polymeric varnish. Such a varnish may be used to form a fluid-tight seal of the joint. For this purpose, the inner face of wall 1 is coated with varnish 6 (FIG. **1*a*), then the bottom 5 is fixed in place before polymerization of the varnish. The bottom 5** may also be pre-varnished.

It is well known that the pressure inside aerosol dispensing cans increases rapidly with temperature and may reach a value of 12 kg/cm$^2$ at a temperature of 50° C. The international safety regulations stipulate that the concave bottom must turn over before the appearance of any leak. Also, it is stipulated that the pressure at which the bottom is ripped off must be equal to or greater than the pressure at which the bottom turns over. FIGS. 2 to 16 illustrate, by way of example, several embodiments of the invention adapted to increase the resistance of the turned over bottom to ripping off. One of the principles applied consists of forming a projection against which the bottom comes to abut when it turns over, the pressure of the bottom on this projection ensuring a pinching of the skirt so that an even greater pressure is necessary to cause ripping off of the bottom by deformation or unrolling of the skirt.

In FIGS. 2 to 15, the turned over bottom is shown in dashed lines.

Figure 2:
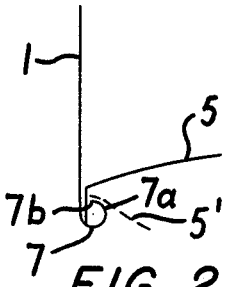

In the embodiment shown in FIG. 2, the gutter or channel 7 of side wall 1 has an approximately circular and closed section. Upon turning over of the bottom 5 to position 5', the latter comes to press against the round upper surface of the channel at **7*a*. Under the effect of this pressure the edge 7*b* of the channel, directed approximately perpendicularly against the skirt of bottom 5, pinches this skirt and prevents bottom 5 from unrolling. The sharper the edge 7*b***, the more it will tend to penetrate into the material of the skirt and retain the bottom. In this case, the fold is open.

Figure 3:
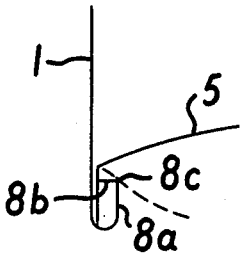

In FIG. 3, the channel has a vertical part **8*a* and an edge 8*b* bent over at right angles in the direction of the skirt of bottom 5. The effect is the same as in FIG. 2 with the difference that when the bottom 5 turns over it comes more rapidly to bear against the bent edge 8*c*** of the channel. In this case, the fold is also open.

Figure 4:
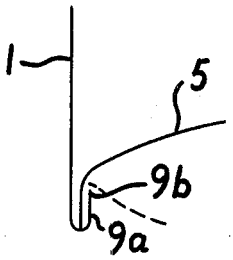

FIG. 4 shows a channel which has a vertical part **9*a* and an edge 9*b* bent over at right angles, but the latter is bent inwardly towards the axis of the can. It can be seen that when the bottom turns over, it comes into contact with the end of edge 9*b*** even quicker.

Figure 5:
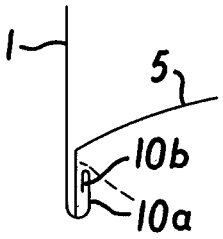

The channel of FIG. 5 has a vertical part **10*a* whose edge is bent over to form a thickened part 10*b* used to pinch the skirt of the bottom when the latter turns over. The thickened part 10*b*** may be obtained by milling or rolling the fold which is thus closed.

Figure 6:
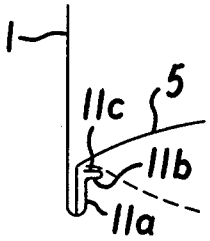

In the embodiment shown in FIG. 6, the channel has a vertical part **11*a* whose upper edge is bent inwards at 11*b* then outwards at 11*c* in a manner to combine the advantages of the embodiments according to FIGS. 3 and 4, the bottom when it turns over coming rapidly to exert a pressure on the channel, as in the case of FIG. 4 and this channel pinches the edge of the skirt as in FIG. 3**.

Figure 7:
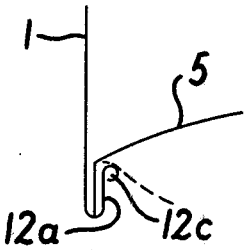

In FIG. 7 the channel has a vertical part **12*a* terminated by an inwardly-directed rolled edge 12*c***.

Figure 8:
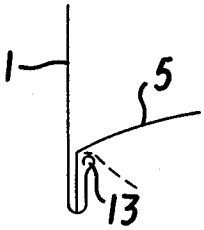

The embodiment of FIG. 8 differs from that of FIG. 7 only by the fact that the rolled edge 13 is directed towards the wall 1.

Figure 9:
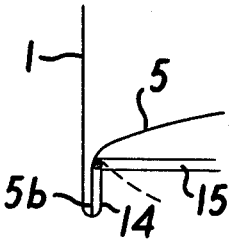

In FIG. 9, the channel 14 is vertical as in FIG. 1 and the means for ensuring a pinching of the skirt **5*b* of the bottom are formed by an inner ring 15 fitted to the channel 14 during or after fitting of the bottom. This ring 15** forms a projection against which the bottom comes to abut when it turns over.

Figure 10:
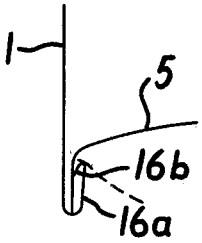

FIG. 10 shows a channel with a vertical part **16*a* whose end 16*b* is bent over at an acute angle towards the wall 1. When the bottom turns over, there is, in addition to the pinching effect as described with reference to FIG. 3, a more pronounced effect of penetration of the edge of end 16*b* into the skirt. The skirt may also be shorter than in FIG. 3** so that the bottom comes rapidly into contact with the upper edge of the channel when it turns over.

Figure 11:
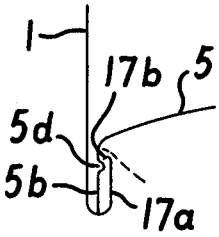
Figure 11A:
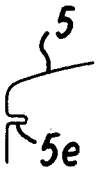

In the embodiment of FIG. 11, the channel also has a vertical or substantially vertical part **17*a* terminating with a part 17*b* bent at an acute angle but the skirt 5*b* of the bottom has a peripheral undulation 5*d* engaged under the end of part 17*b*. When the bottom turns over, the skirt 5*b* is not only pinched but it comes to grip the part 17*b* by undulation 5*d*. In the variation shown in FIG. 11*a*, the undulation 5*d* is replaced by a peripheral fold 5*e***.

Figure 12:
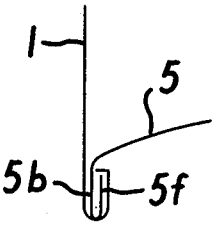

A gripping occurring when the bottom turns over is also provided in the embodiment shown in FIG. 12, in which the skirt **5*b* is folded upwardly and inwardly in a manner to come to hook under the outwardly bent edge of the channel which has a shape analogous to that of FIG. 3. The skirt 5*b*** may be folded over prior to placing of the bottom, or simultaneously formed with the channel.

Figure 13:
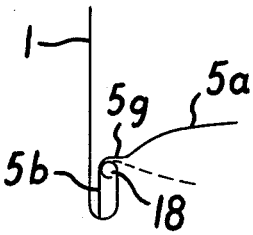

In FIG. 13, the edge of the channel has an outwardly-directed roll 18. The skirt **5*b* of bottom 5 is connected to the dished part 5*a* by a planar or substantially planar part 5*g*. The effect of part 5*g* is to increase the rigidity of the peripheral part of the bottom without preventing the dished part 5*a*** from turning over.

Figure 14:
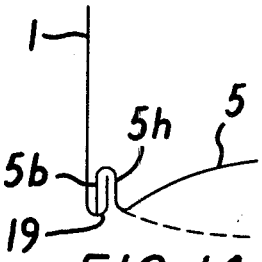

In the embodiment shown in FIG. 14, the channel 19 of the side wall 1 is analogous to the channel 4 of FIG. 1, but the skirt **5*b* of bottom 5 is connected to the dished part 5*a* by a vertical or substantially vertically part 5*h* so that the bottom also has a channel formed by parts 5*b* and 5*h*, opposite to and engaging in channel 19. As in FIG. 13**, the effect of this is to increase the rigidity of the peripheral part of the bottom whereby a higher pressure is required to rip it off.

Figure 15:
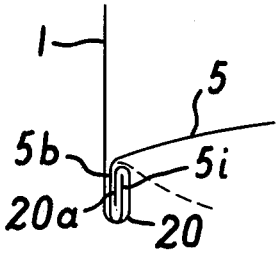

In the embodiment of FIG. 15, the edges of channel 20 and skirt **5*b* are folded over one or another at 20*a* and 5*i* and are hookably engaged in one another, this hooking coming into play when there is an upward traction on skirt 5***b* following turning over of bottom 5. The folds can be formed by milling or rolling.

Figure 16:
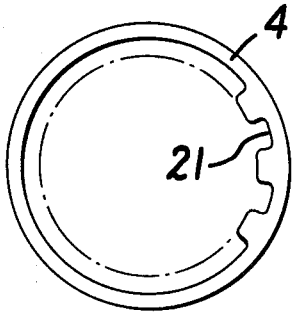

FIG. 16 is an underneath plan view of a can in which a reinforcement of channel 4 is obtained by forming vertical flutes 21 in the channel. Such flutes can be formed in any of the previously described embodiments.

Generally speaking, the operation of forming the channel may be carried out before or after printing the outer surface of the side wall. Moreover, the folded over part of the channel can also receive an imprint, such as a code, trade mark or advertising, but which will only be visible when the can is turned over.

I claim:

1. An aerosol dispensing or similar metal can for containing a fluid under pressure comprising, a tubular can body, a bottom having a dished central bottom portion and a peripheral skirt extending in a direction toward a bottom end of said can body, said central bottom portion being dished in a direction away from said skirt, said can body having a sidewall having a lower, circumferential marginal edge portion reversely folded inwardly to define with said sidewall a channel, said skirt having a peripheral edge seated against an inner bottom surface of said channel, said marginal portion defining said channel comprising an inner edge portion bent relative to said channel circumferentially of the channel defining an outer surface outwardly of said channel remotely from the bottom surface of said channel spaced axially from said dished central portion and disposed in a position to be engaged by said dished central portion upon deflection in a direction away from the top of the can when a given internal pressure in said can is exceeded, said outer surface upon engagement by the central portion effectively applying said edge portion in a direction toward said skirt in said channel and against said skirt, and said outer surface being disposed in position for engagement by said dished central portion upon deflection thereof for retention of said marginal edge portion in position defining said channel.

2. An aerosol dispensing or similar metal can for containing a fluid under pressure according to claim 1, in which said outer surface is arcuate.

3. An aerosol dispensing or similar metal can for containing a fluid under pressure according to claim 1, in which said outer surface is bent defining an outer edge.

4. An aerosol dispensing or similar metal can for containing a fluid under pressure according to claim 1, in which said edge portion is arcuate in cross section, and in which said outer surface thereof is arcuate.

5. An aerosol dispensing or similar metal can for containing a fluid under pressure according to claim 1, in which said bent edge portion is disposed substantially normal to said skirt in said channel, and in which said outer surface is a sharp bend on said marginal edge portion.

6. An aerosol dispensing or similar metal can for containing a fluid under pressure according to claim 1, in which said edge portion is bent arcuate in cross section, said edge portion having an edge for bearing against said skirt in said channel, and in which said outer surface thereof is arcuate.

7. An aerosol dispensing or similar metal can for containing a fluid under pressure according to claim 1, in which said edge portion is bent arcuate in cross section, said edge portion having an arcuate surface for bearing against skirt in said channel, and in which said outer surface thereof is arcuate.

8. An aerosol dispensing or similar metal can for containing a fluid under pressure according to claim 1, in which said edge portion comprises an edge for bearing against said skirt in said channel.

* * * * *